US006120324A

United States Patent [19]

Murayama et al.

[11] Patent Number: 6,120,324

[45] Date of Patent: Sep. 19, 2000

[54] WATERPROOF CONNECTOR

[75] Inventors: Toshisada Murayama; Akira Maeda, both of Shizouka, Japan

[73] Assignee: Yazaki Corporation, Tokyo, Japan

[21] Appl. No.: 09/357,151

[22] Filed: Jul. 19, 1999

[30] Foreign Application Priority Data

Jul. 23, 1998 [JP] Japan ..... 10-208210

[51] Int. Cl.[7] ..... H01R 13/40

[52] U.S. Cl. ..... 439/587; 439/206

[58] Field of Search ..... 439/587, 588, 439/589, 275, 271, 283, 752.5, 205, 206

[56] References Cited

U.S. PATENT DOCUMENTS

| | | | |
|---|---|---|---|
| 4,662,692 | 5/1987 | Uken et al. | 339/96 |
| 5,529,508 | 6/1996 | Chiotis et al. | 439/204 |
| 5,961,351 | 10/1999 | Wu | 439/610 |

FOREIGN PATENT DOCUMENTS

| | | | |
|---|---|---|---|
| 64-63282 | 3/1989 | Japan | H01R 13/52 |

*Primary Examiner*—Gary F. Paumen
*Assistant Examiner*—Truc Nguyen
*Attorney, Agent, or Firm*—Sughrue, Mion, Zinn, Macpeak & Seas, PLLC

[57] ABSTRACT

The waterproof connector comprises a connector housing 31 with a plurality of terminal storage chambers 33 formed therein, an inner wall surface 37 which is formed in the inside of the connector housing 31 and on which a plurality of terminal mounting insertion openings 39 respectively in communication with their associated terminal storage chambers 33 are opened, and a plate-shaped gel 45 held within the connector housing in parallel to the inner wall surface 37, while a plurality of terminals, which have been made to pass through the gel 45, are respectively inserted from their associated terminal mounting insertion openings 39 to be thereby mounted into their associated terminal storage chambers 33. In the waterproof connector, on the respective peripheral edges of the terminal mounting insertion openings 39 of the inner wall surface 37, there are formed gel escape spaces 43 into which part of the gel 45 is allowed to advance.

4 Claims, 5 Drawing Sheets

PRIOR ART

PRIOR ART

WATERPROOF CONNECTOR

BACKGROUND OF THE INVENTION

1. Field of Invention

The present invention relates to a waterproof connector including a waterproof gel through which a terminal is made to pass and, in particular, to a waterproof connector which, when a terminal is made to pass through a gel, can prevent the cutoff gel from sticking to the connecting portion of the terminal.

2. Related Art

Conventionally, as means for sealing off a space between a housing of a connector and a terminal to be guided from the housing, there is sometimes used grease. However, in the grease, there are found some drawbacks to be improved. In particular, the grease will lower in viscosity at high temperatures and thus can flow out of the sealing space to thereby unstabilize the sealed state of the sealing space. Also, once used, the grease becomes difficult to remove, which makes it difficult to inspect and repair the connector.

Further, in this type of sealing structure, instead of the grease, there is sometimes used epoxy-system adhesive. In this case, it is true that a highly reliable sealing structure can be realized, but, after the adhesive is hardened, reuse of the adhesive, especially, reinsertion of the adhesive is difficult.

As a waterproof connector which can eliminate the above drawbacks, for example, there is known a waterproof connector which is disclosed in Japanese Patent Publication Sho.64-63282. Referring here to this waterproof connector, as shown in FIG. 8, the waterproof connector includes a square-frame-shaped rear holder 1 opened on the mutually opposing surfaces thereof which are arranged in parallel to each other; and, on the inner periphery of one opening 3 of the rear holder 1, there is projectingly provided a frame-shaped stopper 5. A plate-shaped base 7 is inserted into the rear holder 1. In particular, the base 7 is stored within the rear holder 1 in such a manner that it is contacted with the stopper 5 and is thereby prevented against removal from one opening 3. In the base 7, there are opened up a plurality of terminal pass-through holes 8 in a lattice manner.

Into the rear holder 1 with the base 7 stored therein, there is inserted a plate-shaped mat seal member (gel) 13 from the other opening 11 thereof. As shown in FIG. 9, the gel 13 is held by a hold projection 15 provided within the rear holder 1 in such a manner that the outer periphery of the gel 13 is in close contact with the inner peripheral surface of the rear holder 1 and one surface of the gel 13 is in close contact with the back surface of the base 7. As shown in FIG. 10, the rear holder 1 is structured such that the other opening 11 thereof can be fitted with the rear portion of a housing 17. In the rear portion of the housing 17, there is opened up a terminal mounting insertion opening 19 which is in communication with a terminal storage chamber. The terminal mounting insertion opening 19 is in alignment with the terminal through hole 9. That is, the terminal mounting insertion opening 19 and terminal through hole 9 are interrupted by the gel 13 which is interposed between them.

To insert a terminal 23 into the thus assembled connector, the terminal 23 with an electric wire 21 connected thereto may be inserted into the terminal pass-through hole 9 of the base 7 from the surface of the rear holder 1 on which side the base 7 is exposed. The terminal 23 passes through the gel 13 while thrusting through the same, and is then mounted into its corresponding terminal storage chamber formed within the housing 17. As a result of this, the outer periphery of the electric wire 21, which has passed through the gel 13, is closely contacted with the gel 13 to thereby be able to seal off the space between the electric wire 21 and housing 17.

According to the above-mentioned waterproof connector, not only there can be prevented the flow-away of the grease caused by the high temperatures, but also there is possible the re-insertion of the terminal which is impossible in the previously-mentioned conventional connector using the epoxy-system adhesive.

However, in the above-cited waterproof connector, the gel is in close contact with the whole periphery of the peripheral edge of the terminal mounting insertion opening. For this reason, as shown in FIG. 11, when the terminal 23 is pressed against the gel 13 and is made to pass through the gel 13 while thrusting through the same, part of the gel, which exists on the pass-through hole exit side and is in close contact with the inner wall surfaces 25 of the housing 17, loses all means of escape, so that such part of the gel 13, together with the terminal 23, is caused to expand out and pushed into the terminal mounting insertion opening 19.

As a result of this, such expanded portions 13*a* are cut off from the gel 13 and, as shown in FIG. 12, the expanded portions 13*a* turn out into cutoff crumbs 13*b*: that is, there is a possibility that the cutoff crumbs 13*b*, together with the terminal 23, can invade the terminal storage chamber 27. In this case, when the present connector is connected with its mating connector, there is a fear that the cutoff crumbs 13*b* can invade between the contacts of the mutually connected terminals to thereby cause poor conduction between them.

SUMMARY OF THE INVENTION

The invention aims at eliminating the drawbacks found in the above-cited conventional connector. Accordingly, it is an object of the invention to provide a waterproof connector which not only can eliminate a fear that, when the terminal passes through the gel, part of the gel contacted with the inner wall surfaces of the housing and losing all means of escape can be pushed into the terminal mounting insertion opening, but also can prevent the lowering of the conduction reliability caused by the invasion of the gel cutoff crumbs between the contacts of the mutually connected terminals.

In attaining the above object, according to the invention, there is provided a waterproof connector comprising: a connector housing with a plurality of terminal storage chambers formed therein; an inner wall surface which is formed in the inside of the connector housing and on which a plurality of terminal mounting insertion openings respectively in communication with the terminal storage chambers are opened; and, a plate-shaped gel held within the connector housing in parallel to the inner wall surface, wherein a plurality of terminals, which have been made to pass through the gel, are respectively inserted from the terminal mounting insertion openings to be thereby mounted into the terminal storage chambers,provided in that, on the respective peripheral edges of the terminal mounting insertion openings of the inner wall surface, there are formed gel escape spaces into which part of the gel is allowed to advance.

In the present waterproof connector, if the terminal is inserted into the connector housing, then the terminal is contacted with the gel; and, if the terminal is inserted further, then the terminal advances while cutting or thrusting through the gel, and passes through the gel. In this operation, since the gel is pressed by the terminal, part of the gel is expanded out on the surface side thereof that is supported by the small pieces. The gel expanded portion is allowed to escape into the gel escape spaces formed between the small pieces. This eliminates a possibility that the gel expanded portion losing all means of escape can be pushed together with the terminal into the terminal mounting insertion opening.

Also, according to the present invention, on the respective peripheral edges of the terminal mounting insertion openings, there are disposed a plurality of small pieces respectively projecting from the inner wall surface toward the gel, and spaces between the small pieces are used as the gel escape spaces.

In the present waterproof connector, the gel escape spaces can be formed between the small pieces which are respectively projected from the inner wall surface. Since the gel is in part allowed to escape into the gel escape spaces, the gel can be prevented from moving into the terminal mounting insertion openings.

Further, according to the present invention, in the waterproof connector as set forth in claim 1, the small pieces are flexed in their mutually parting directions.

In the present waterproof connector, if the terminal is pressure inserted into the gel, then the small pieces, on receiving a reactive force generated due to such pressure insertion of the terminal, are moved apart from each other in their mutually parting directions. As a result of this, the surface of the gel supported on the leading end faces of the small pieces is pulled in the flexing direction of the small pieces. Due to this, the gel expanded portion, which is located on the pass-through opening side on which the gel is cut through by the terminal, is decreased in thickness; and, when the terminal thrusts through the expanded portion, the peripheral edge of the gel pass-through opening is contracted in the direction where it parts away from the terminal, thereby increasing the diameter of the gel pass-through opening, which makes it possible to prevent the expanded portion from moving into the terminal mounting insertion opening.

Still further, according to the present invention, in the waterproof connector as set forth in first aspect, on the respective peripheral edges of the terminal mounting insertion openings of the inner wall surface, there are formed a plurality of recessed portions used as the gel escape spaces.

In the present waterproof connector, since the gel escape spaces are composed of the recessed portions, the length of the connector housing in the terminal inserting direction thereof can be shortened when compared with the structure in which the small pieces are respectively projected from the inner wall surface of the connector housing.

DETAILED DESCRIPTION OF PREFERRED EMBODIMENTS

Now, description will be given below in detail of the preferred embodiments of a waterproof connector according to the invention with reference to the accompanying drawings. In particular, FIG. 1 is an exploded perspective view of a first embodiment of a waterproof connector according to the invention, FIG. 2 is a section view taken along the arrow line A—A shown in FIG. 1, in which a small piece leading end face is shown by oblique lines, FIG. 3 is an enlarged perspective view of the peripheral edge of a terminal mounting insertion opening on which a plurality of small pieces are projectingly provided, and FIG. 4 is a section view of the waterproof connector according to the invention, showing a state thereof in which it is assembled.

Figure 1:
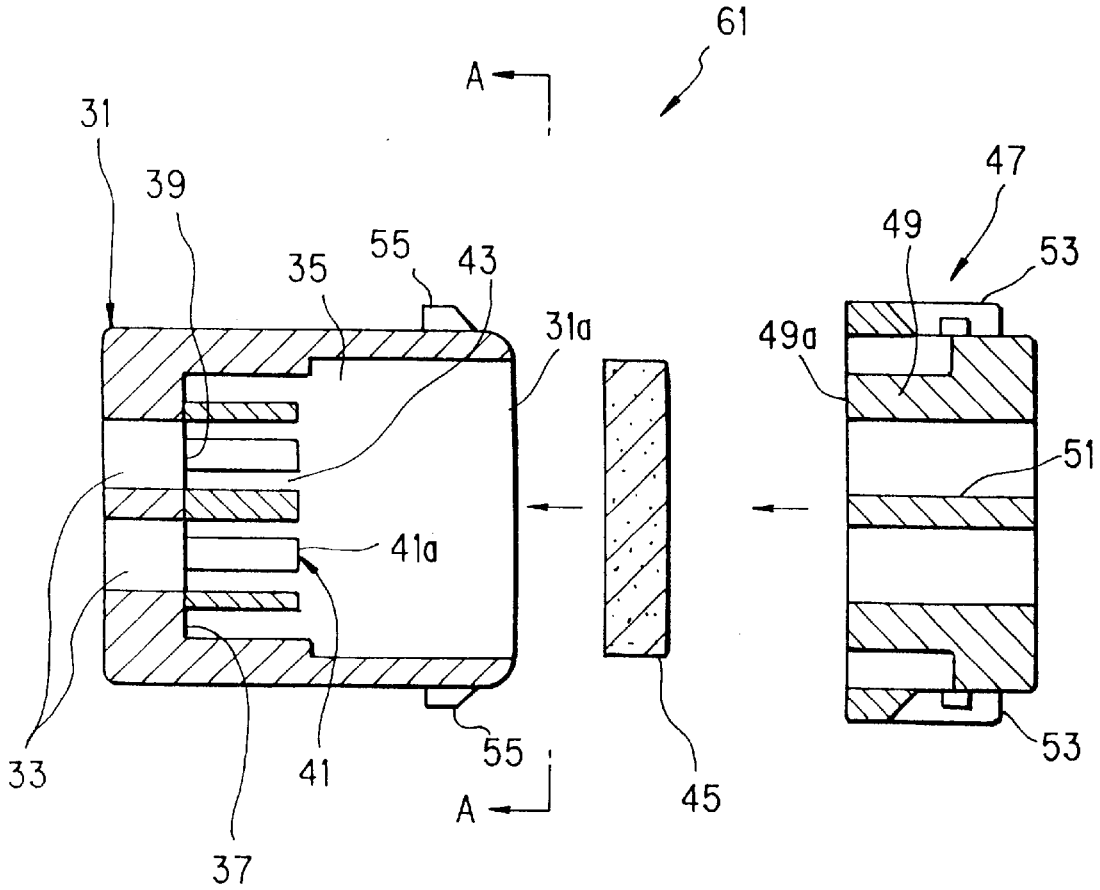
FIG. 1 is an exploded perspective view of an embodiment of a waterproof connector according to the invention.

As shown in FIG. 1, according to this embodiment, there is used a connector housing 31 which is formed of resin material or the like in an integrally united body and, in the connector housing 31, there are formed a plurality of (in the illustrated embodiment, two upper and lower stages and four right and left lines of ) terminal storage chambers 33. In the inside of the connector housing 31, there is formed a cavity portion 35 and, on one inner wall surface 37 of the cavity portion 35, there are opened a plurality of terminal mounting insertion openings 39 which are respectively in communication with their associated terminal storage chambers 33. Part of the cavity portion 35 provides a space for storing therein a gel (which will be discussed later).

Figure 2:
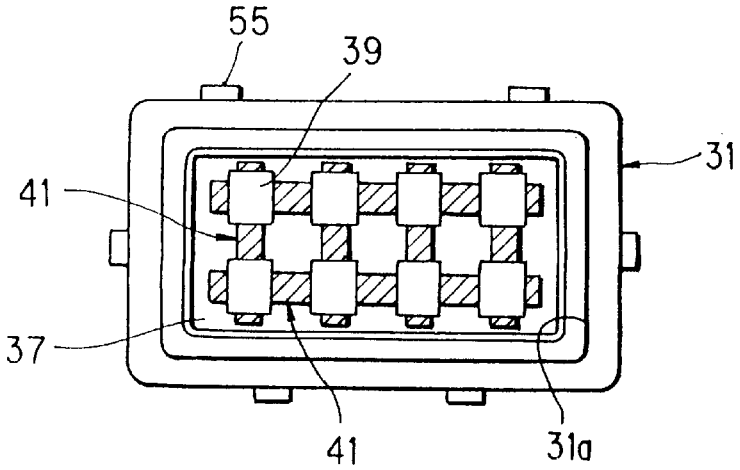
FIG. 2 is a view taken along the arrow line A—A shown in FIG. 1, in which the leading end face of a small piece is shown by oblique lines.

As shown in FIG. 2, according to the present embodiment, each of the terminal mounting insertion openings 39 is formed in a rectangular shape.

Figure 3:
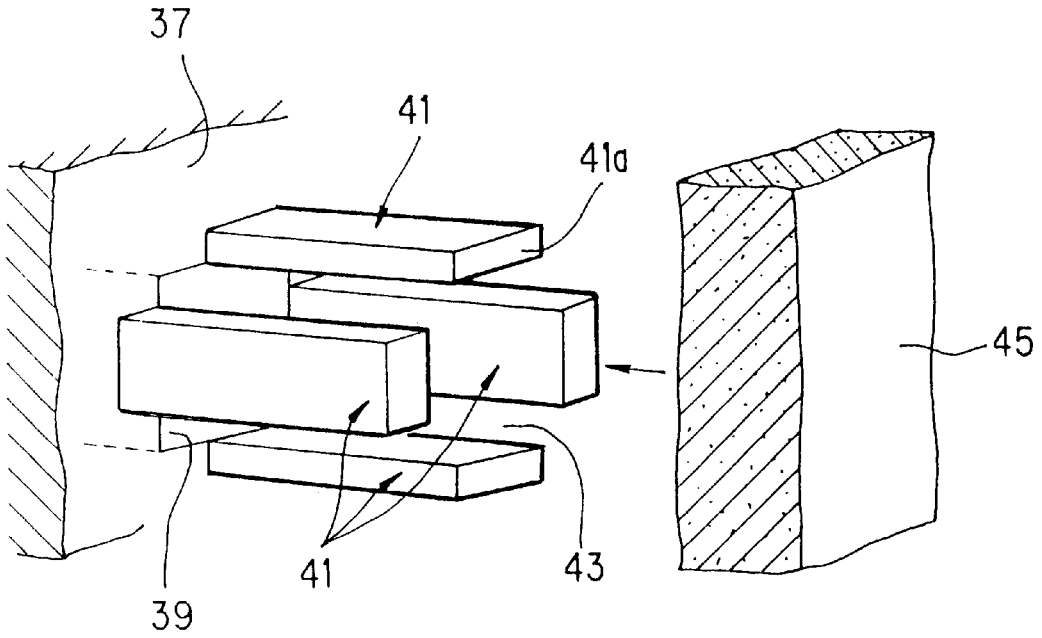
FIG. 3 is an enlarged perspective view of the peripheral edge of a terminal mounting insertion opening on which the small pieces are projectingly provided.
Figure 4:
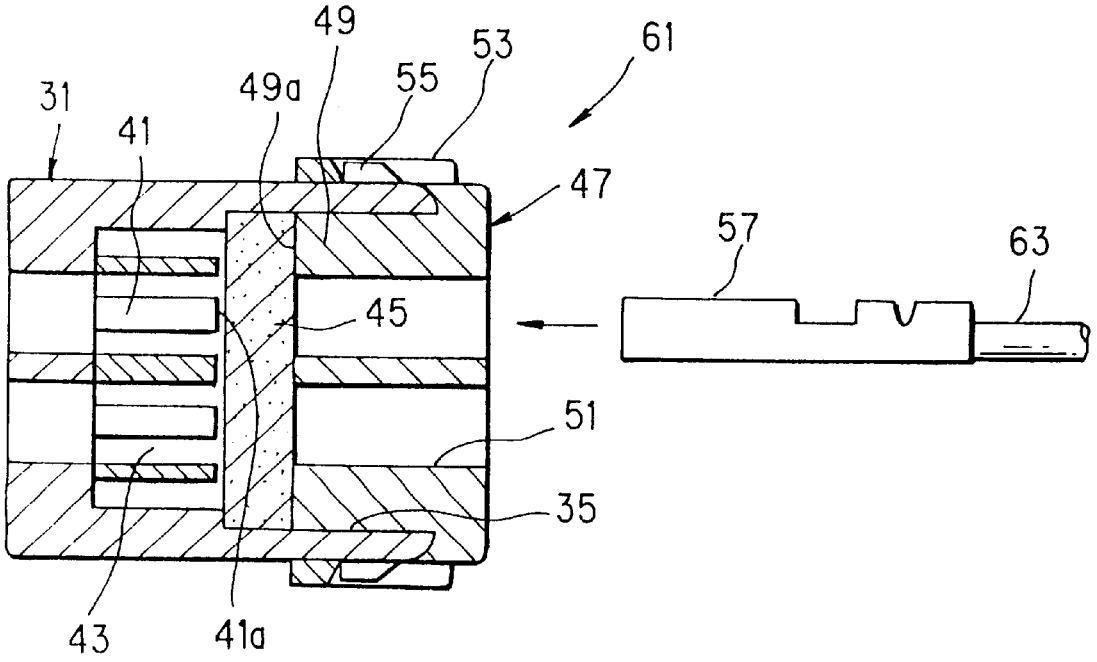
FIG. 4 is a section view of the embodiment of a waterproof connector according to the invention, showing its assembled state.

And, as shown in FIG. 3, on the peripheral edge of the terminal mounting insertion opening 39, there are disposed four small pieces 41 which respectively project from the inner wall surface 37 at right angles thereto, one small piece 41 on one of the four sides of the peripheral edge. In the present embodiment, as shown in FIG. 2, the small piece 41, which is interposed between the two mutually adjoining terminal mounting insertion openings 39, is used as a common small piece 41. The small piece 41 includes a leading end face 41*a* composed of a plane which extends in parallel to the inner wall surface 37. Also, the small piece 41 is structured such that the length thereof in the respective sides of the terminal mounting insertion opening 39 is shorter than the lengths of the respective sides of the terminal mounting insertion opening 39.

Therefore, the mutually adjoining small pieces 41 are separated from each other, that is, they are opened on the corner portions of the mutually adjoining terminal mounting insertion openings 39. The thus opened gap provides a gel escape space portion 43.

The cavity portion 35 provides an opening 31*a* at the rear end (in FIG. 1, the right end) of the connector housing 31, that is, the cavity portion 35 is opened here. From the opening 31*a*, there can be inserted a plate-shaped mat seal member (that is, a gel) 45. As the gel 45, preferably, there can be used a silicone gel or the like. The gel 45 is structured such that the outer shape thereof is substantially the same as the section shape of the cavity portion 35. After the gel 45 is inserted from the opening 31*a*, it is stored within the air cavity 35 in such a manner that one surface thereof is in contact with the leading end face 41*a* of the small piece 41.

Now, a rear holder 47 shown in FIG. 1 is to be mounted on one end side (in FIG. 1, the right side) of the above-structured connector housing 31. On the front end face (in FIG. 1, the left side surface) of the rear holder 47, there is formed an insertion portion 49 which is to be inserted into the opening 31*a* of the cavity portion 35. The insertion portion 49 includes a leading end face 49*a* which extends in parallel to the inner wall surface 37 of the cavity portion 35. Also, in the rear holder 47, there is formed a terminal insertion passage 51 the two ends of which are respectively opened on the leading end face 49*a* of the insertion portion 49 and the rear end face (in FIG. 1, the right side surface) of the rear holder 47. The terminal insertion passage 51 is disposed in such a manner that it corresponds to the terminal mounting insertion opening of the connector housing 31.

On the upper and lower outer wall surfaces of the rear holder 47, there are respectively formed frame-shaped securing portions 53 which are capable of deforming elastically. On the other hand, the respective rear ends of the upper and lower wall surfaces of the connector housing 31, there are projectingly provided projections 55 which can be respectively secured to their associated securing portions 53. To mount the rear holder 47 onto the connector housing 31, the insertion portion 49 may be inserted into the opening 31*a* and the securing portions 53 may be secured to the projections, so that, as shown in FIG. 4, the rear holder 47 can be mounted onto the rear end of the connector housing 31.

As shown in FIG. 4, when the rear holder 47 has been mounted on the rear end of the connector housing 31, the leading end face 49*a* of the insertion portion 49 and the leading end faces 41*a* of the small pieces 41 grip the gel 45 between them from the two sides thereof and the cavity portion 35 holds the gel 45 therein. Therefore, according to the thus assembled waterproof connector, the respective front-side openings of the terminal insertion passages 51 are closed by the gel 45. In other words, in the present waterproof connector, in this state, the assembling of the connector housing 31, gel 45 and rear holder 47 is completed. On completion of the assembling operation of the waterproof connector, a terminal 57 is inserted into the waterproof connector from the rear end of the rear holder 47.

Next, description will be given below of the operation of the waterproof connector 61 the respective parts of which are structured in the above-mentioned manner.

Figure 5:
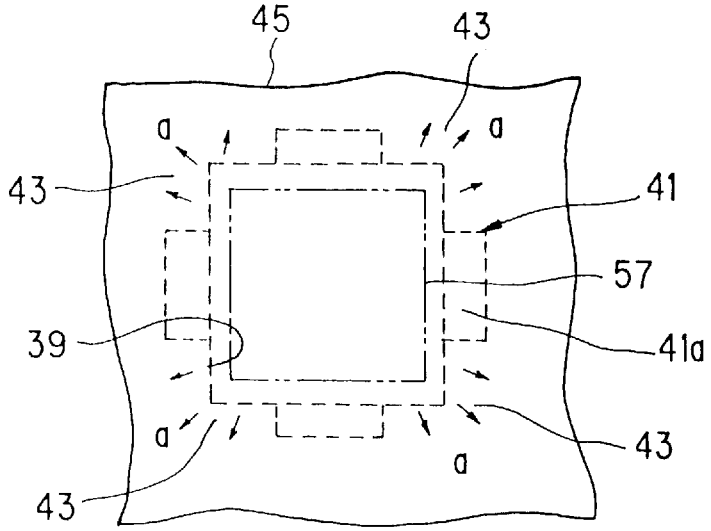
FIG. 5 is an explanatory view of the escaping directions of a gel when a terminal is inserted.
Figure 6:
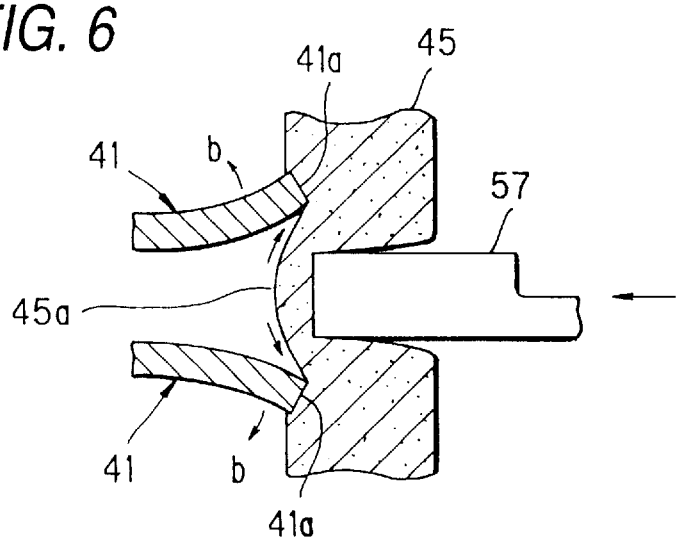
FIG. 6 is an explanatory view of the states of the gel and small piece when the terminal is inserted.

Here, FIG. 5 is an explanatory view of the escaping directions of the gel 45 when the terminal is inserted, and FIG. 6 is an explanatory view of the states of the small pieces and gel when the terminal is inserted.

That is, if the terminal 57 with an electric wire 63 connected thereto is inserted into the terminal insertion passage 51 from the rear end of the rear holder 47, then the leading end of the terminal 57 is contacted with the gel 45 disposed on the front end face of the terminal insertion passage 51. In this state, if the terminal 57 is pressure inserted further, then it advances through the gel 45 while cutting off the same and finally passes through the gel 45 in the thickness direction thereof.

In this operation, as shown in FIG. 5, the surface of the gel 45, which is located on the opposite side to the surface thereof that is pressed by the terminal 57, is supported by the leading end face 41*a* of the small piece 41. And, the gel 45 is pressed by the terminal 57, so that part of the gel 45 is expanded out toward the surface thereof supported by the small pieces 41. In particular, the thus expanded portion is made to escape into the gel escape spaces 43 respectively formed between the small pieces 41, that is, in the direction shown by reference character a.

Figure 11:
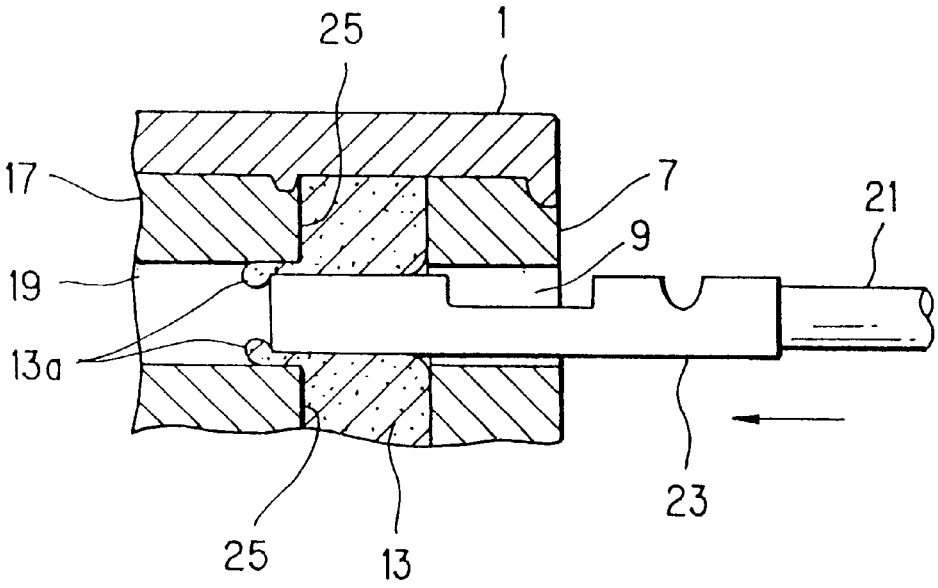
FIG. 11 a section view of a gel expanded portion cut off from a gel due to insertion of a terminal.
Figure 12:
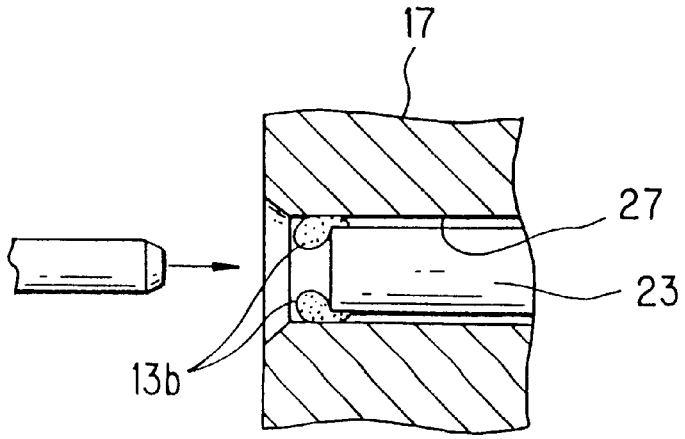
PRIOR ART FIG. 12
FIG. 12 is an enlarged section view of the waterproof connector connecting surface with the gel cutoff crumbs stuck thereto.

This eliminates the possibility that the expanded portion losing all means of escape, as shown in FIG. 11, can be expanded and pushed into the terminal mounting insertion opening. As a result of this, only the terminal 57 having passed through the gel 45 is allowed to advance into the terminal mounting insertion opening 39. And, following the terminal 57, the electric wire 63 passes through the gel 45 and thus the gel 45 is closely contacted with the outer periphery of the electric wire 63, whereby the space between the electric wire 63 and connector housing 31 can be sealed watertight by the gel 45.

Also, the above-mentioned push-in of the gel 45 into the terminal mounting insertion opening when the terminal 57 is inserted can be controlled at the same time by other operation than the above. That is, as shown in FIG. 6, if the terminal 57 is pressure inserted into the gel 45, then the leading end portions of the small pieces 41, on receiving a reactive force generated by the pressure insertion of the terminal 57, are moved away from each other in their mutually parting directions b and b. As a result of this, the surfaces of the gel 45 respectively supported by the leading end faces 41*a* of the small pieces 41 are respectively pulled in the flexing directions b of their associated small pieces 41 as the small pieces 41 are moved away from each other.

Due to this, the expanded portion 45*a*, which is located on the terminal pass-through opening side of the gel 45 that is pushed through and cut off by the terminal 57, is decreased in thickness when compared with a structure in which the small pieces 41 are not flexed. Therefore, when the terminal 57 pushes through and cuts off the expanded portion 45*a*, the peripheral edge of the gel pass-through opening on the terminal exit side through which the terminal 57 has passed is contracted in a direction b in which the peripheral edge of the present opening parts away from the terminal 57. This prevents the expanded portion 45 from advancing into the terminal mounting insertion opening 39.

In this manner, in the waterproof connector 61, due to the combined effect of the operation described in connection with FIG. 5 and the operation described in connection with FIG. 6, the push-in of the gel 45 into the terminal mounting insertion opening 39 can be surely prevented. By the way, use of either of the above-mentioned operations is able to prevent the invasion of the expanded portion 45*a* into the terminal mounting insertion opening 39.

Thus, according to the above-mentioned waterproof connector 61, since the small pieces 41 are provided on and projected from the peripheral edge of the terminal mounting insertion opening 39 and the spaces between the small pieces 41 are used as the gel escape spaces 43, when the terminal 57 is made to pass through the gel 45, the expanded portion 45*a* of the gel 45 is allowed to escape into the gel escape spaces 43, thereby being able to prevent the push-in of the gel 45 into the terminal mounting insertion opening 39. Also, because the small pieces 41 are flexed in their mutually parting directions when the terminal 57 passes through the gel 45, the expanded portion 45*a* of the gel 45 can be reduced in thickness, which also makes it possible to prevent the gel 45 from being pushed into the terminal mounting insertion opening 39.

As a result of this, there is eliminated the possibility that the gel 45 can advance into the terminal storage chamber 33; and, therefore, when the thus structured waterproof connector is connected with its mating connector, there is no fear that the gel cutoff crumbs pushed into the terminal storage chamber 33 can invade between the mutually connected electric contact portions of the two connectors. That is, the present waterproof connector is surely able to prevent occurrence of poor conduction that could otherwise be caused by the gel cutoff crumbs.

By the way, in the above-mentioned embodiment, on the respective side portions of the terminal mounting insertion openings 39, there are projectingly provided the small pieces 41 which are respectively shorter in length than the lengths of the side portions in the side directions thereof, whereby there are formed the gel escape spaces 43 between the small pieces 41. However, this is not limitative but, according to the invention, the gel escape spaces 43 can also be formed by other structures.

Figure 7:
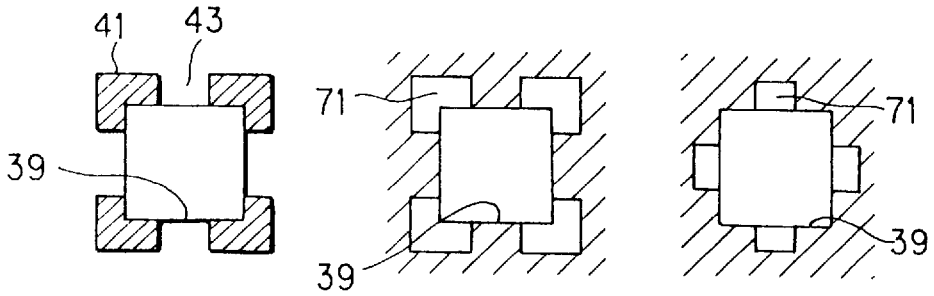
FIGS. 7(*a*)–7(*c*) are partially enlarged views of the peripheral edge of the terminal mounting insertion opening, showing a modification of the gel escape space.
Figure 8:
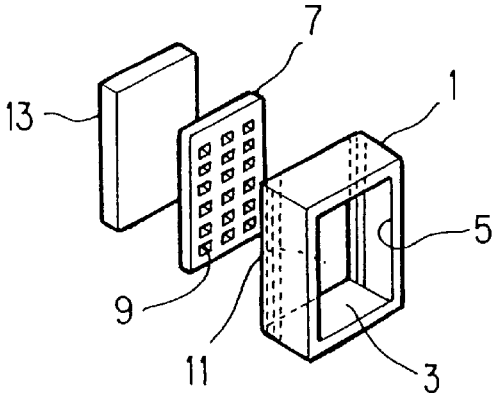
FIG. 8 is an exploded perspective view of a rear holder portion of a conventional waterproof connector.
Figure 9:
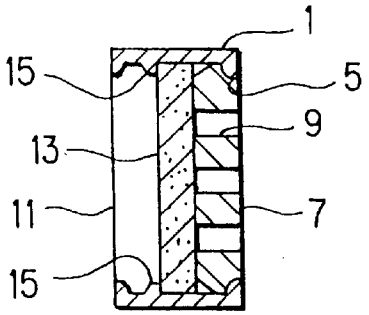
PRIOR ART FIG. 9
FIG. 9 is a section view of a rear holder with a gel stored therein, which is employed in the conventional waterproof connector.
Figure 10:
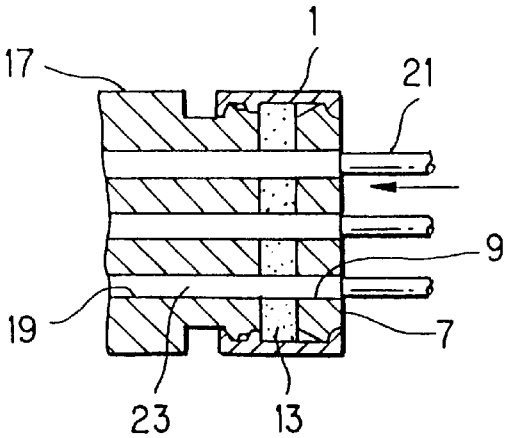
PRIOR ART FIG. 10
FIG. 10 is a section view of the main portions of the structure of the conventional waterproof connector.

That is, as shown in FIG. 7 (*a*), only on the corner portions of the terminal mounting insertion opening 39, there may be projectingly provided the small pieces 41 each having an L-shaped section, whereby the gel escape spaces 43 may be formed in the respective central portions of the four sides of the terminal mounting insertion opening 39. Also, on the peripheral edge of the terminal mounting insertion opening 39, there may be formed recessed portions 71 and the recessed portions 71 may be used as the gel escape spaces. In particular, the recessed portions 71, as shown in FIG. 7 (*b*), may be formed in the four corner portions of the terminal mounting insertion opening 39, or, as shown in FIG. 7 (*c*), may be formed in the respective central portions of the four sides of the terminal mounting insertion opening 39. If the gel escape spaces are composed of the recessed portions 71 in this manner, then the length of the connector housing 31 in the terminal inserting direction thereof can be shortened when compared with the structure in which the small pieces 41 are provided on and projected from the inner wall surface 37 of the cavity portion 35 of the connector housing 31.

As has been described heretofore in detail, in the waterproof connector according to the invention, since the gel escape spaces are formed on the peripheral edge of the terminal mounting insertion opening, when the terminal is made to pass through the gel, the expanded portion of the gel is allowed to escape into the gel escape spaces, thereby being able to prevent the gel from being pushed into the terminal mounting insertion opening.

As a result of this, there is eliminated the possibility that part of the gel can flow into the terminal storage chamber and, therefore, when the present waterproof connector is connected with its mating connector, there is no fear that the gel cutoff crumbs pushed into the terminal storage chamber can invade between the mutually connected electric contact portions of the two connectors, which makes it surely possible to prevent occurrence of the poor conduction that can be caused by the gel cutoff crumbs in the conventional connector.

What is claimed is:

1. A waterproof connector comprising:

a connector housing with a plurality of terminal storage chambers formed therein;

an inner wall surface which is formed in the inside of said connector housing and on which a plurality of terminal mounting insertion openings respectively in communication with said terminal storage chambers are opened;

a plate-shaped gel held within said connector housing in parallel to said inner wall surface, a plurality of terminals, which have been made to pass through said gel, being respectively inserted from said terminal mounting insertion openings to be thereby mounted into said terminal storage chambers; and gel escape spaces into which part of said gel is allowed to advance, said gel escape spaces formed on the respective peripheral edges of said terminal mounting insertion openings of said inner wall surface.

2. A waterproof connector as set forth in claim 1, wherein a plurality of pieces respectively projecting from said inner wall surface toward said gel are disposed on the respective peripheral edges of said terminal mounting insertion openings, and spaces between said pieces are used as said gel escape spaces.

3. A waterproof connector as set forth in claim 2, wherein said pieces are flexed in their mutually parting directions.

4. A waterproof connector as set forth in claim 1, wherein a plurality of recessed portions are formed on the respective peripheral edges of said terminal mounting insertion openings of said inner wall surface, and recessed portions are used as said gel escape spaces.

* * * * *